US006257734B1

(12) United States Patent
Tchira

(10) Patent No.: US 6,257,734 B1
(45) Date of Patent: Jul. 10, 2001

(54) FLASHLIGHT WITH LUMINESCENT HOUSING HAVING A TRITIUM CAPSULE

(76) Inventor: Joseph Tchira, 3640 Yacht Club Dr. #304, Aventura, FL (US) 33180

( * ) Notice: Subject to any disclaimer, the term of this patent is extended or adjusted under 35 U.S.C. 154(b) by 0 days.

(21) Appl. No.: 09/406,423

(22) Filed: Sep. 27, 1999

Related U.S. Application Data

(60) Provisional application No. 60/116,259, filed on Jan. 19, 1999.

(51) Int. Cl.[7] ..... F21L 4/04

(52) U.S. Cl. ..... 362/202; 362/34; 362/159; 362/188; 362/206; 362/208; 429/57

(58) Field of Search ..... 362/157, 158, 362/187, 188, 202, 203, 204, 205, 206, 207, 208, 84, 34, 159, 171; 424/48, 57, 58, 59, 60

(56) References Cited

U.S. PATENT DOCUMENTS 2,694,772 * 11/1954 Gelardin ..... 362/189
3,409,770 * 11/1968 Clapham, Jr. ..... 240/467.1
3,943,937 * 3/1976 King et al. ..... 607/36
4,127,134 * 11/1978 Ushakoff ..... 607/9
4,242,724 * 12/1980 Stone ..... 362/158
4,546,416 * 10/1985 Pemberton ..... 362/84
4,819,141 * 4/1989 Maglica et al. ..... 362/207

* cited by examiner

*Primary Examiner*—Thomas M. Sember
*Assistant Examiner*—Ismael Negron
(74) *Attorney, Agent, or Firm*—Robert J. Vanderwall

(57) ABSTRACT

A flashlight apparatus includes a quantity of tritium within a transparent capsule for emitting light independently of any power source for helping a person locate the apparatus in the absence of substantial external light. The tritium glows in the dark for many years without any external power source. The apparatus also includes the conventional elements of a power source, a primary light source, a power circuit for electrical communication between the power source and the primary light source, a switch, and a housing containing the power source, the primary light source. The light source is preferably a light emitting diode, and may alternatively be an incandescent bulb. The light emitting diode is preferably a high intensity, low power consuming light emitting diode. The transparent capsule includes a vial containing the tritium, which capsule provides a virtually unbreakable enclosure.

19 Claims, 4 Drawing Sheets

FLASHLIGHT WITH LUMINESCENT HOUSING HAVING A TRITIUM CAPSULE

CROSS REFERENCE TO RELATED APPLICATION

The present application continues from a provisional patent application Ser. No. 60/116,259 filed Jan. 19, 1999, and claims the filing date thereof as to the common subject matter.

BACKGROUND OF THE INVENTION

1. Field of the Invention

The present invention relates to the general field of portable lighting devices and, more specifically, to a flashlight having substantially permanent luminescence not requiring an external energy source to stimulate the luminescence. It also optionally includes a housing sized to receive one or more batteries. One of the embodiments includes a square cross-section battery tube insert to fit into the housing to receive batteries smaller than the inside diameter of the housing to leave an annular floatation air space within the housing to make the flashlight buoyant.

2. Description of Prior Art

Ever since the invention of portable electrical storage batteries, it is been practical to carry around portable lighting devices which use incandescent bulbs as the light source. The most relevant reference that has been located is Pemberton, U.S. Pat. No. 4,546,416, which describes a flashlight in combination with phosphorescent material. However, the phosphorescent material must be rejuvenated by exposure to light at frequent intervals, a shortcoming overcome by the present invention because of its substantially permanent luminescence. Other prior art includes Pietruczynik, et al., U.S. Pat. No. 5,752,761, Sato, U.S. Pat. No. 5,757,111, McDermick, U.S. Pat. No. 5,842,777, McDermick, U.S. Pat. No. 5,161,879, Maglica, U.S. Pat. No. 5,260,858, Price, III, U.S. Pat. No. 4,843,526, Sharrah, et al., U.S. Pat. No. 5,853,241, et al., Maglica U.S. Pat. No. 5,836,672, Maglica, U.S. Pat. No. 5,528,472 and numerous other references. So far as is known no reference combines a flashlight with a substantially permanent luminescent housing.

SUMMARY OF THE INVENTION

Bearing in mind the foregoing, it is a principal object of the present invention to provide a flashlight that can always be located in the dark regardless of how long it has been there because of substantially permanent luminescence.

Another object of the invention is to combine those features with a flashlight that floats lens end up in water.

A further object of the invention is to combine the principal aspect of the invention with a lens which can be focused from a wide angle to a pinpoint of light, usually only when a single primary light source is used, such as a single incandescent bulb.

An additional object of the invention is to combine the principal aspect of the invention with a lens that is shatter proof.

Another object of the invention is to combine the principal aspect of the invention with the capability of using one or more low energy consumption, ultra bright light emitting diode(s) (LED) as an alternative to an incandescent bulb.

Another object of the invention is the to provide a flashlight having the foregoing characteristics with a slip proof grip.

Other objects and advantages will be apparent to those skilled in the art upon reference to the following descriptions and the accompanying drawings.

In accordance with a primary aspect of the invention, there is provided a flashlight including a power source, a primary light source, a power circuit connecting the power source to the primary light source, and a housing containing the power source and the light source and including a quantity of tritium within a translucent vial, which in turn is disposed within a virtually unbreakable protective transparent structure termed a capsule. The tritium within the capsule emits light independently of the power source to help a person locate the apparatus in the absence of substantial external light.

The light source is preferably at least one low energy consumption, ultra bright light emitting diode (LED), and may alternatively be an incandescent bulb. The LED is preferably a high intensity LED that achieves long duration from its battery power source by reason of its low energy consumption characteristics. The power source is one of several options: at least one larger diameter battery and at least one smaller diameter battery. The flashlight is offered in large and small battery diameter sizes, but the large diameter housing optionally includes a square cross-section battery tube that fits snugly within the housing inside diameter to define a floatation air space between the battery tube and the housing inside diameter. This makes the flashlight buoyant so it will float lens up. The apparatus preferably additionally includes a housing end wall. The housing is preferably formed of translucent material.

The apparatus preferably additionally includes a lens ring removably fitted to the housing. The apparatus preferably still additionally includes a tab of catalyst material secured within the housing for accelerating the neutralization of hazardous gaseous battery emissions.

The housing has an outer surface which preferably includes a series of rib projections for improved gripping in a user hand. The housing preferably has a external threads at one end thereof and the lens ring preferably has internal threads and are sized to fit and engagingly screw over the housing external threads. The apparatus preferably additionally includes an O-ring receiving groove in a portion of the housing outer surface and an O-ring fitted snugly into the O-ring receiving groove to create a watertight seal between the housing and the lens ring. The battery tube preferably has a square cross-section resulting in battery tube corners for abutting the housing inside diameter.

The capsule preferably includes two mating capsule halves at least one of which includes a recess in an interior face, the interior faces being fixedly attached to each other using one or more peg(s) and bore(s) to define one virtually unbreakable capsule. The capsule half having the recess provides a hollow within the capsule for snugly containing the vial of tritium.

The apparatus preferably additionally includes two loops of housing material extending from opposing sides of the housing and defining a region within the loops which each receive and fixedly retain one of the capsules. The power circuit preferably includes the power source, the light source, and a conductive metal strip embedded longitudinally in the housing.

A better understanding of the invention may be achieved by reference to the drawings in which:

DETAILED DESCRIPTION OF PREFERRED EMBODIMENTS

Figure 1:
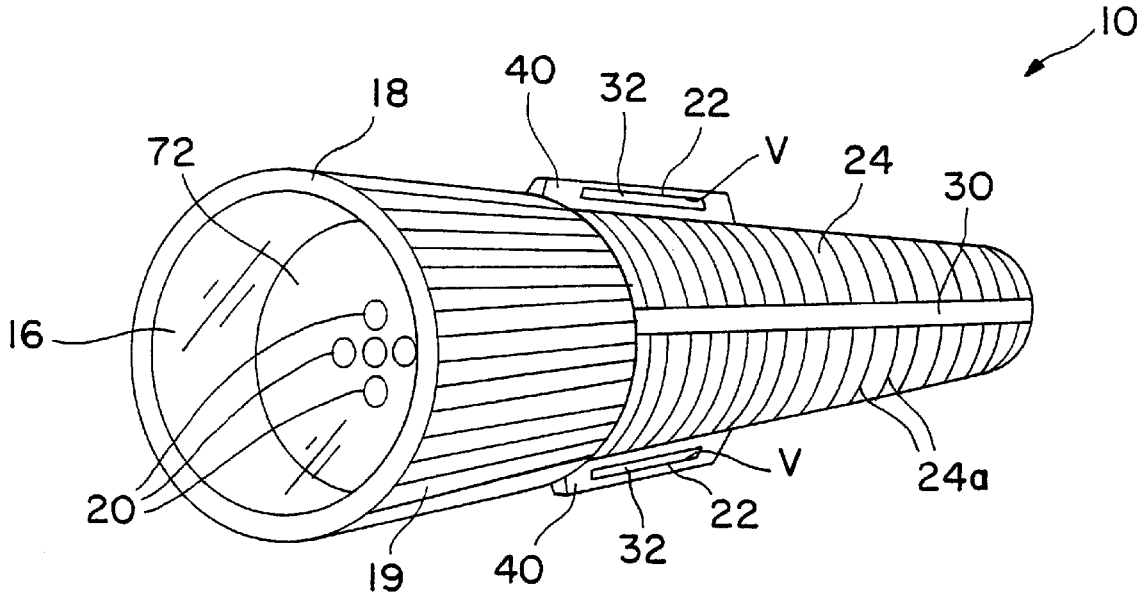
FIG. 1 is a perspective view of the larger diameter flashlight of the first preferred embodiment.

As required, a detailed embodiment of the present invention is disclosed herein. However, it is to be understood that the disclosed embodiment is merely exemplary of the invention which may be embodied in various forms. Therefore specific structural and functional details disclosed herein are not to be interpreted as limiting, but merely as a basis for the claims to be later added and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

First Preferred Embodiment

Figure 3:
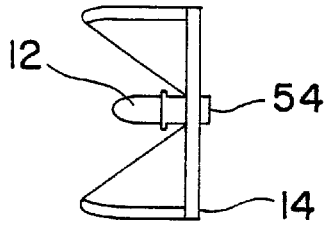
FIG. 3 is a cross-sectional side view of the reflector used for the xenon incandescent bulb light source option.
Figure 2:
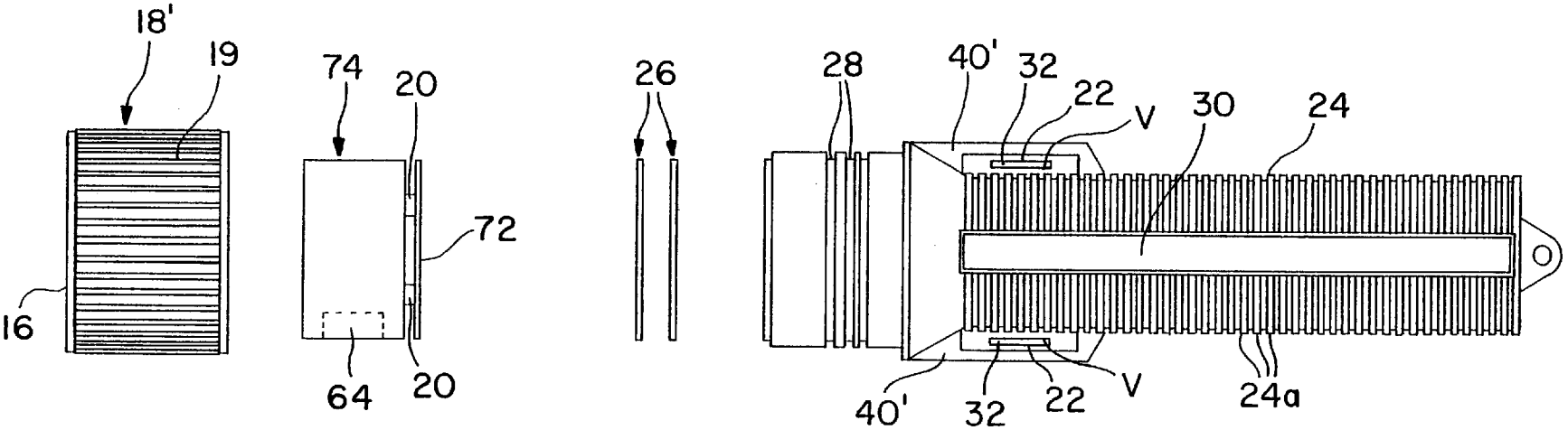
FIG. 2 is an exploded side view of the larger diameter flashlight of FIG. 1, which contains C batteries, showing the lens ring, spacer ring, LED's and LED mounting plate, the two O-rings and the flashlight housing with O-ring grooves and opposing side loops containing tritium capsules.

FIGS. 1–3 disclose a flashlight with a luminescent housing in the form of a tubular housing 24 shown generally at 10. Flashlight 10 contains a power circuit 30 connected to a high intensity low power consuming light emitting diode (LED) 20 or a high intensity bulb 12 mounted within a conventional parabolic reflector 14. Also shown is a focusing shatter proof lens 16 disposed within a rotatable lens ring 18, 18' or 18 rotatably secured to housing 24 in front of reflector 14, having a lens ring gripping surface 19. The focusing feature is intended to be used with a single primary light source such as an incandescent bulb, but may in the future be usable with one or more LED's as well. Also seen are two luminescent capsules 22 for making flashlight 10 luminescent and thus conspicuous and easily located in low light conditions. Capsules 22 are secured longitudinally to opposing sides of housing 24.

Housing 24 is formed of translucent, heavy duty, impact resistant plastic with circumferential ribs 24*a* along most of its length to provide a virtually slip-proof gripping surface. Lens ring 18 is internally threaded and the forward end of housing 24 is externally threaded to engagingly and rotatably receive lens ring 18. Two O-rings 26 are fitted into two O-ring grooves 28 in the exterior of housing 24 adjacent to the housing 24 external threads to create a waterproof seal between housing 24 and lens ring 18.

Capsules 22 are a key inventive feature of the flashlight, and each contains a quantity of tritium 32. By way of explanation tritium is a radioactive form or radioisotope of the hydrogen atom in which two neutrons are added to the normal single proton in the nucleus of the atom. The half life of this radioisotope is 12.3 years. Tritium is not hazardous outside of living tissue, so therefore it is safe when kept within a specially designed container which, in the case of this invention are capsules 22.

Figure 7:
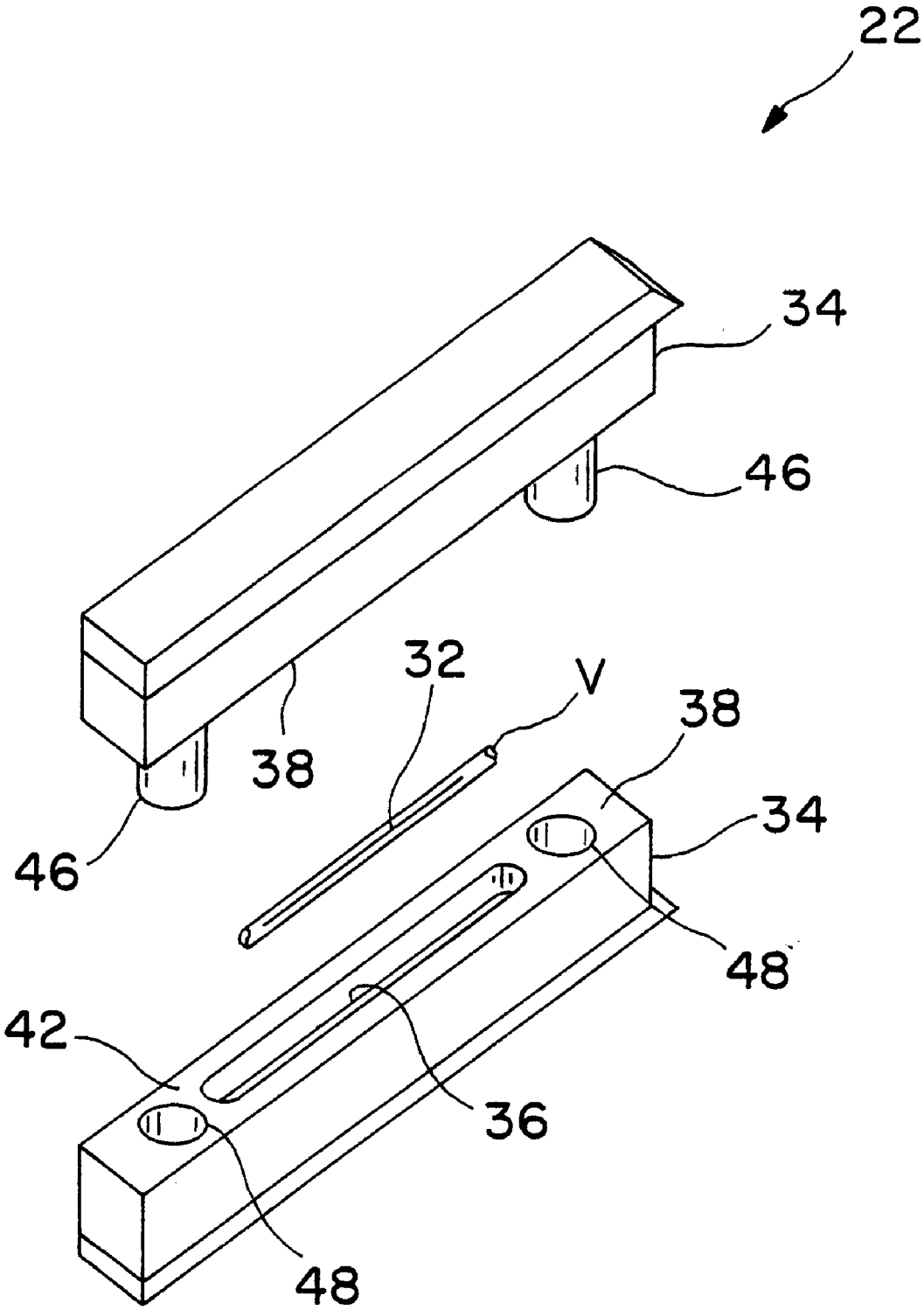
FIG. 7 is an exploded perspective view of one of the capsules, showing the capsule halves separated and the vial of tritium positioned between them for containment within a hollow defined by the first half's recess.

Capsules 22 are each transparent, extremely durable and virtually impenetrable. See FIGS. 2 and 7. Each capsule 22 preferably is formed of two mating capsule halves 34 made of very tough plastic, one of which has a recess 36. In manufacturing capsules 22, a small vial V of tritium 32 is placed into a recess 36 of a one of the capsule halves 34. Each of the capsule halves 34 are equipped with interior faces 38, which are interrupted with one or more peg(s) 46 and bore(s) 48. The one or more peg(s) 46 and bore(s) 48 are the preferred method to fixedly attach the capsule halves together. An alternative method is to add a bonding agent 42 in addition or in lieu of the peg(s) and bore(s), which is spread over the interior face 38 surrounding the recess 36 if used.

In any event, the vial V of tritium 32 is placed in recess 36 of first capsule half 34 and then a second capsule half 34 is oriented so that first capsule interior face 38 is abutting face to face with the second capsule interior face 38, and vial V is contained within the recess 36 and then the capsule is assembled. If bonding agent 42 is used, it grips and optionally partially melts the first and second capsule interior faces 38 so that they solidify together. Whether or not bonding agent 42 is used, the assembly of the two capsule halves 34 form a monolithic capsule 22 containing a fully sealed hollow defined by the two opposing capsule halves 34, one of which includes recess 36. For all practical purposes, capsule 22 is virtually indestructible. Capsules 22 are each fixedly attached, optionally with agent 42, longitudinally on opposite sides along the outside surface of housing 24 adjacent to lens ring 18, 18 or 18. It is preferred that a pair of peg portions 46 protrude from one of the capsule half interior face 38 of one of the capsule halves 34 and penetrate into a pair of mating peg bores 48 disposed in the other of the capsule halves 34 for fixedly attaching the capsule halves 34 together.

It is preferred that elongate loops 40 or 40', formed of housing material, extend from opposing sides of housing 24 and define a region within loops 40 or 40' which receive and fixedly retain the capsules 22. Loops 40 or 40' protrude sufficiently from housing 24 that they abut the surface on which flashlight 10 rests when housing 24 rolls, to stop the rolling of housing 24 with the opposing loop 40 and its capsule 22 elevated over the remainder of housing 24 for the user to have an unobstructed view of the elevated capsule 22 so that it can be more readily seen in the dark.

Figure 6:
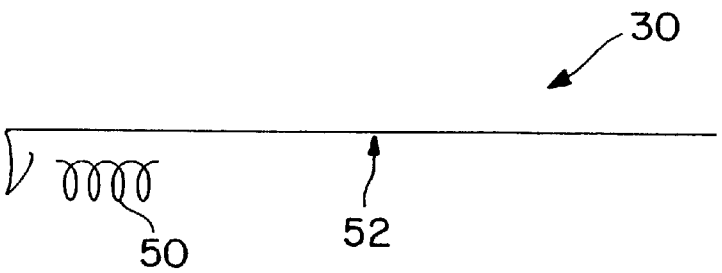
FIG. 6 is a side view of the metal strip and battery spring making up most of the electric circuit.

Power circuit 30 includes several batteries 44 and a battery coil spring 50, which biases batteries 44 forwardly within housing 24. A conductive metal strip 52 is electrically connected to spring 50 and extends along and is embedded longitudinally within a side of housing 24 to deliver electrical power from batteries 44 to LED 20 or to a bulb socket 54. See FIG. 6. Rotating the lens ring 18, 18' or 18 to tighten it over housing 24 advances the light source toward batteries 44 so that the terminal ends of batteries 44 make firm conductive contact with circuit 30 and thus complete circuit 30 to turn on the flashlight in the manner of a switch.

Figure 5:
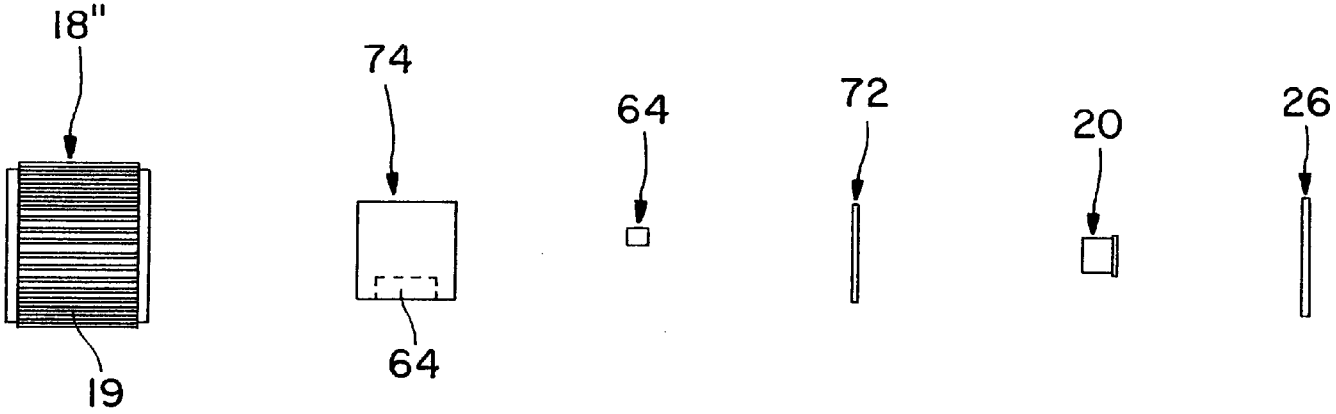
FIG. 5 is an exploded view of the remaining elements making up the smaller diameter flashlight, including the lens ring, spacer ring, catalyst shown in broken lines, O-rings and LED.
Figure 4:
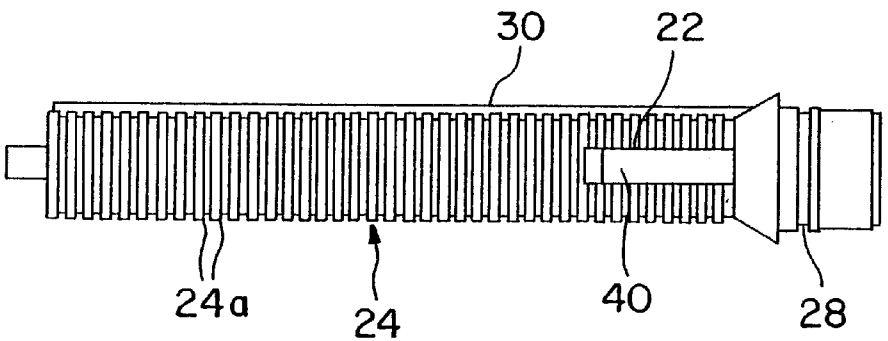
FIG. 4 is a side view of the housing for the smaller diameter flashlight containing the AA batteries. This one is not buoyant because it lacks the annular floatation space.

The preferred LED 20 is what is known as a high output, high intensity or ultra bright LED which operates on 4 four volts of electric power. To create sufficient voltage to illuminate such an LED 20, three C or AA batteries are required, and housing 24 has to be about eight inches long to contain these batteries stacked in series. A larger diameter housing 24 is provided of a conventional, sufficient diameter to receive C batteries. See FIG. 2. An alternative smaller diameter housing 24 is provided of sufficient diameter to receive AA batteries. See FIGS. 4–5.

Figure 8:
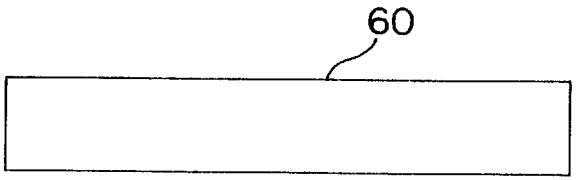
FIG. 8 is a side view of the square battery tube.
Figure 9:
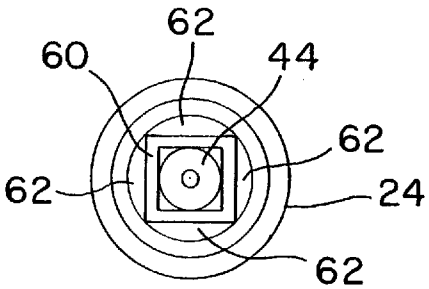
FIG. 9 is a front view of the larger diameter flashlight with the lens, lens ring and light source removed, revealing the square battery tube fitted within the housing and containing AA batteries, also revealing the floatation air space around the battery tube.

The larger diameter housing flashlight shown in FIG. 2 may be converted to accept the smaller diameter AA batteries, and at the same time to become buoyant. To achieve this transformation, lens ring 18 and reflector 14 are momentarily removed from housing 24 and a square battery tube 60 is fitted longitudinally into housing 24. See FIGS. 8 and 9. Battery tube 60 is preferably concentric and coaxial with housing 24 and thus defines an annular floatation air space 62 between battery tube 60 and housing 24. Battery tube 60 is sized in internal dimension and length to retain three of the AA size batteries, which have a smaller diameter than C size batteries. Floatation air space 62 gives the flashlight buoyancy so that flashlight floats if dropped in the water. Since the batteries 44 are heavy relative to the remainder of the flashlight and since their center of gravity is offset toward the rear of housing 24, the flashlight floats with the forward end oriented upwardly. As a result, so that capsules 22 with their radiated light are at the water surface, rendering the flashlight visible. Should the LED 20 or bulb 12 in the flashlight be on, its beam of light also makes the flashlight highly visible while floating in this upright orientation. Battery tube 60 has a square cross-section and its external corners loosely abut the interior of housing 24 to generally center tube 60 within housing 24.

The lens ring 18, 18' or 18 preferably contains a tab of catalyst material 64 secured along the ring inward surface for absorbing or neutralizing any hydrogen gas emitted by the batteries 44. Catalyst 64 thereby prevents a build-up of hydrogen gas within housing 24, which might be detonated by electricity within circuit 30 and cause injury to the user. One or several LED's 20 may be attached through LED ports in a disk-shaped mounting plate 72. See FIG. 2. LED's 20 are spaced inwardly from the sides of plate 72 to be centered to cast more light out of housing 24, and so a spacer ring 74 is preferably fitted around LED's 20 to fill the gap between the LED's and the outside diameter of housing 24. Catalyst 64 is preferably attached to the inward surface of spacer ring 74.

Second Preferred Embodiment

A compact flashlight is provided with a shorter housing 24 containing only one battery 44. See FIGS. 1–3, generally. One battery cannot create sufficient voltage to operate a high intensity LEp 20, and so an high intensity bulb 12 is substituted for LED 20. The preferred high intensity bulb 12 is what is known as a "Xenon" bulb.

While the invention has been described, disclosed, illustrated and shown in various terms with a preferred embodiment where it clear that other embodiments or modifications may be assumed in practice, the scope of the invention is not intended to be, nor should it be deemed to be, limited thereby and such other modifications or embodiments as may be suggested by the teachings herein are particularly reserved especially as they fall within the breadth and scope of the claims appended hereto.

What is claimed is:

1. A flashlight apparatus, comprising:

a power source;

a light source;

a power circuit in electrical communication with the power source and the light source;

at least one capsule containing tritium;

a tab of catalyst material for accelerating the neutralization of hazardous gaseous battery emissions; and a housing containing the power source, the light source, the power circuit, the tab of catalyst material, and the capsule.

2. The apparatus of claim 1, wherein the capsule comprises:

two capsule halves at one of which having a recess in a capsule interior face, the interior faces of both capsule halves being fixedly attached to each other using at least one peg(s) and bore(s) mating snugly; and tritium disposed in the recess.

3. The apparatus of claim 1, wherein the power circuit further comprises a conductive metal strip embedded longitudinally in the housing for effecting the electrical communication between the power source and the light source.

4. The apparatus of claim 1, wherein the housing is translucent.

5. The apparatus of claim 1, wherein the capsule is transparent.

6. The apparatus of claim 1, wherein the housing has an outer surface at least partially comprising a series of ribbed projections.

7. The apparatus of claim 1, wherein the light source is at least one light emitting diode.

8. The apparatus of claim 7, wherein the light emitting diode is a high intensity low power consuming light emitting diode.

9. The apparatus of claim 1, wherein the capsule further comprises two capsule halves having interior faces with at least one recess in which is disposed the tritium.

10. The apparatus of claim 9, wherein the capsule further comprises:

at least one peg in a first capsule half interior face;

at least one bore in a second capsule half interior face; and a mating close fitting relationship between the peg(s) and bore(s) to fixedly attach the capsule halves together and form a monolithic capsule.

11. The apparatus of claim 1, wherein the power source is one of: at least one larger diameter battery and at least one smaller diameter battery, and wherein the housing includes a housing inside diameter adapted to accommodate a larger diameter battery, the apparatus further comprising:

a battery tube having external dimensions smaller than the housing inside diameter to define a floatation air space between the battery tube and the housing for making the apparatus buoyant; and having a battery tube inside dimension adapted to receive the smaller battery outside diameter.

12. The apparatus of claim 11, wherein the battery tube has a square cross-section defining battery tube outer corners for fitting snugly within the housing inside diameter.

13. The apparatus of claim 1, further comprising:

at least one loop of housing material extending from a side of the housing and defining a region within the loop to receive and fixedly retain a capsule.

14. The apparatus of claim 13 in which there are two loops of housing material extending from opposing sides of the housing defining two regions to receive and retain two capsules.

15. The apparatus of claim 1, further comprising a lens ring removably fitted to the housing.

16. The apparatus of claim 15, further comprising an O-ring receiving groove in the housing and an O-ring fitted snugly into the O-ring receiving groove to create a water-tight seal between the housing and the lens ring.

17. The apparatus of claim 15, wherein the lens ring further comprises a focusing shatter proof lens.

18. The apparatus of claim 15, wherein the housing further comprises housing external threads and the lens ring further comprises lens ring internal threads and wherein both of these threads engage each other.

19. The apparatus of claim 18 in which rotating the lens ring to tighten it over the housing advances the light source toward the power source closing the power circuit to turn on the light source in the manner of a switch.

* * * * *